US006081932A

United States Patent [19]

Kraemer

[11] Patent Number: 6,081,932

[45] **Date of Patent: *Jul. 4, 2000**

[54] CHIN STRAP ASSEMBLY FOR USE WITH AN ATHLETIC HELMET

[75] Inventor: Nelson Kraemer, Mt. Prospect, Ill.

[73] Assignee: Riddell, Inc., Chicago, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/840,026

[22] Filed: Apr. 24, 1997

[51] Int. Cl.[7] ..... A42B 3/08

[52] U.S. Cl. ..... 2/421

[58] Field of Search ..... 2/410, 411, 421, 2/422, 425, 9, 417

[56] References Cited

U.S. PATENT DOCUMENTS

| | | | |
|---|---|---|---|
| 1,262,818 | 4/1918 | McGill . | |
| 2,250,275 | 7/1941 | Riddell | 2/2 |
| 2,867,811 | 1/1959 | Jones | 2/3 |
| 3,187,342 | 6/1965 | Aileo | 2/3 |
| 3,327,313 | 6/1967 | Pukish | 2/3 |
| 3,619,813 | 11/1971 | Marchello | 2/3 |
| 3,787,895 | 1/1974 | Belvedere | 2/9 |
| 3,916,446 | 11/1975 | Gooding | 2/3 |
| 4,044,400 | 8/1977 | Lewicki | 2/421 |
| 4,461,044 | 7/1984 | Reiterman | 2/421 |
| 4,646,368 | 3/1987 | Infusino et al | 2/421 |
| 4,651,356 | 3/1987 | Zide | 2/421 |
| 4,692,947 | 9/1987 | Black et al. | 2/421 |
| 4,741,054 | 5/1988 | Mattes | 2/421 |
| 5,347,660 | 9/1994 | Zide et al. | 2/421 |

FOREIGN PATENT DOCUMENTS 1354719 5/1974 United Kingdom .

OTHER PUBLICATIONS

Two pages of photographs Nos. 1–7 depicting a "Chin Strap" design.

Gear 2000, Ltd. brochure, Gear 2000, Ltd., Dec. 1994.

Letter dated July 7, 1998 from Ed Tobergte, President of Gear 2000, Ltd.

*Primary Examiner*—Michael A. Neas

*Attorney, Agent, or Firm*—Tobor & Goldstein, L.L.P.

[57] ABSTRACT

The chin strap assembly for use with an athletic helmet includes a chin cup member having a flexible strap on each side of the chin cup member, each flexible strap passing through a plurality of slots formed in the chin cup member.

12 Claims, 3 Drawing Sheets

CHIN STRAP ASSEMBLY FOR USE WITH AN ATHLETIC HELMET

BACKGROUND OF THE INVENTION

1. Field of the Invention

The invention relates to an improved chin protector for use with helmets, such as football helmets.

2. Description of the Prior Art

Various activities, such as contact sports and hazardous occupations, require the use of helmets to protect participants from injury to their heads due to impact forces that may be sustained during such activities. Conventional helmets may typically include a chin strap assembly having a flexible or rigid chin cup member that fits snugly about a wearer's chin, to secure the helmet to the wearer's head and to further minimize injuries to the wearer's chin from impact. Free ends of the chin strap assembly are typically snapped to the lower edges of the helmet.

Existing chin strap assemblies may utilize a single flexible strap, which is either threaded through the chin cup or that is formed integral with the chin cup. When single flexible straps are used, the flexible strap typically extends colinear with, through, and from the chin cup, and is affixed to opposing sides of the helmet with a single fastener on each side of the helmet. Other chin strap assemblies may utilize a separate flexible strap on each side of the chin cup, which is typically riveted, glued, stitched, or otherwise fixedly attached at a free end of the chin strap to the chin cup.

Other chin strap assemblies may utilize, in addition to the primary flexible strap, a secondary set of flexible straps, either affixed to and extending from the chin cup itself or affixed to and extending at an angle from a portion of the primary flexible straps to a second fastener on each side of the helmet. Such angularly extending secondary straps may provide additional support, as well as assist in proper placement of the chin cup on the chin of the wearer of the helmet. Typically, such straps are sewn to the primary straps at a position proximate the chin cup. It may be desirable to remove and/or replace the flexible strap of a chin strap assembly in the event the flexible strap may become worn or dirty. The use of angularly extending secondary straps may provide benefits in placement of the chin cup on the wearers chin or provide additional strength to the chin strap assembly; however, such existing chin strap assemblies have heretofore made removal and/or replacement of the flexible straps difficult.

Other chin strap assemblies have provided means for adjusting, or fixing, the configuration of the length and/or angle of the flexible straps as they extend from the chin cup. Such adjustment means have included the use of rivets, stitching, or D-rings to determine and/or adjust the flexible strap configuration. The use of such adjustment means may allow for either improper adjustment by the user or may provide no adjustment at all.

It should be noted that as to the chin protector of the present invention, as well as prior art chin protectors, due to the nature of the sport of football in particular, no protective equipment can completely prevent injuries to those playing the sport of football. It should be further noted that no protective equipment can completely prevent injuries to a player, since the football player may use his football helmet in an improper manner, such as to butt, ram, or spear an opposing player. Improper use of a helmet to butt, ram, or spear an opposing player can result in severe head and/or neck injuries, paralysis, or death to the football player, as well as possible injury to the football player's opponent. No football helmet and no chin protector therefor, such as that of the present invention, can prevent all head, chin, or neck injuries a football player might receive while participating in the sport of football, particularly if the football player improperly uses his helmet. However, it is believed that the chin strap assembly of the present invention may provide additional strength, will provide a fixed angle for the support of the chin cup by the flexible straps, and may provide for easy removal and/or replacement of the flexible straps, while providing a dual suspension system to improve the placement of the chin cup on the wearer's chin.

SUMMARY OF THE INVENTION

In accordance with the invention, some of the foregoing advantages may have been achieved through the present adjustable chin strap assembly for use with a helmet. The adjustable chin strap assembly of the present invention may include: a chin cup member, having first and second opposing sides; first and second strap adjustment means formed integral with, and located on, the first and second opposing sides of the chin cup member, respectively; a first support member for supporting the first side of the chin cup member; a second support member for supporting the second side of the chin cup member; and attachment means for securing the support members to the athletic helmet. Another feature of this aspect of the invention, is that the first and second support members may each include a single flexible strap with an end portion, each flexible strap being threadably attached through slots provided in the first and second opposing sides of the chin cup member. In another feature of this aspect of the invention, each adjustment means may include a connecting portion formed integral with the chin cup member, the connecting portion defining first and second through-extending slots. In another feature of this aspect of the invention, the first and second through-extending slots may each have a long axis associated therewith, the long axis defining a predetermined angle therebetween, which may have a value of approximately 30 degrees. In still another feature of this aspect of the invention, the attachment means may include a fastener adapted to be secured to the athletic helmet and slidably disposed in connection with the end portions of the first and second flexible straps for securing the support members to the athletic helmet. In another feature of this aspect of the invention, the first flexible strap may be threadably disposed through the first and second through-extending slots of the first connecting portion of the chin cup member, and the second flexible strap of the second support member may be threadably disposed through the first and second through-extending slots of the second connection portion of the chin cup member.

In accordance with another aspect of the invention, some of the foregoing advantages may have been achieved through the present chin strap assembly for use with a helmet, which may include: a chin cup member, having first and second opposing sides and a central axis extending between the first and second opposing sides of the chin cup member; first and second connecting portions formed integral with, and located on opposite sides of, the chin cup member, each connecting portion including first, second, and third through-extending slots, each slot having a long axis associated therewith, the long axis of the first through-extending slots of the first and second connecting portions are each disposed generally perpendicular to the central axis of the chin cup member, the long axis of the first and second through-extending slots of the first and second connecting portion defines an angle therebetween in a range of between 10 and 45 degrees, the long axis of the second through-extending slots of the first and second connecting portions defining an angle with respect to the central axis that is in a range of between 45 degrees and 80 degrees, and the long axis of the third through-extending slots of the first and second connecting portions defining an angle with respect to the central axis that is in a range of between 95 degrees and 115 degrees; a first flexible strap, threadably passing through the first, second, and third through-extending slots of the first connecting portion, an upper portion of the first flexible strap disposed along the central axis of the chin cup member and being adapted to be fixed to a first side of the athletic helmet, a lower portion of the first flexible strap extending from the second through-extending slot of the first connecting portion and being adapted to be fixed to the first side of the athletic helmet; and a second flexible strap, threadably passing through the first, second and third through-extending slots of the second connecting portion, an upper portion of the second flexible strap disposed along the central axis of the chin cup member and being adapted to be fixed to a second side of the athletic helmet, a lower portion of the second flexible strap extending from the second through-extending slot of the second connecting portion and being adapted to be fixed to the second side of the athletic helmet.

In accordance with still another aspect of the invention, some of the foregoing advantages may have been achieved through the present chin strap assembly for use with a helmet, which may include: a chin cup member, having first and second opposing sides; first and second connecting portions formed integral with, and located on, the first and second opposing sides of the chin cup member; only one first flexible strap with an end portion supporting the first side of the chin cup member, the only one first flexible strap being threadably disposed in connection with the first connecting portion of the chin cup member; only one second flexible strap with an end portion supporting the second side of the chin cup member, the only one second flexible strap being threadably disposed in connection with the second connecting portion of the chin cup member; and attachment means for securing each end portions of the only one first and second flexible straps to the athletic helmet.

In accordance with another aspect of the invention, some of the foregoing advantages may have been achieved through the present chin strap assembly for use with a helmet, which may include: a chin cup member, having a central axis associated therewith; first and second opposing sides; at least three first slots extending therethrough proximate the first opposing side of the chin cup member, each of the at least three first slots being angularly disposed with respect to the central axis and adapted to receive a flexible strap; and at least three second slots extending therethrough proximate the second opposing side of the chin cup member, each of the at least three second slots being angularly disposed with respect to the central axis and adapted to receive a flexible strap; a single first flexible strap, threadably disposed through the at least three first slots of the first opposing side of the chin cup member, an upper portion of the first flexible strap extending in a direction generally away from the chin cup member and generally along the central axis of the chin cup member, and a lower portion of the first flexible strap extending in a direction generally away from the chin cup along an axis angularly disposed approximately 30 degrees from the central axis of the chin cup member; and a single second flexible strap, threadably disposed through the at least three second slots of the second opposing side of the chin cup member, an upper portion of the second flexible strap extending in a direction generally away from the chin cup member and generally along the central axis of the chin cup member, and a lower portion of the second flexible strap extending in a direction generally away from the chin cup and angularly disposed approximately 30 degrees from the central axis of the chin cup member, whereby the single first flexible strap may be affixed to a first side of the athletic helmet at two spaced-apart locations, and whereby the single second flexible strap may be affixed to a second, opposing, side of the athletic helmet at two spaced-apart locations.

The chin strap assembly of the present invention, when compared with previously proposed prior art chin strap assemblies, has the advantages of: providing additional strength to the chin strap assembly; providing for easy removal and/or replacement of the flexible straps; providing a second set of flexible straps to improve the placement of the chin cup on the wearer's chin; and providing a fixed exit angle for the dual chin strap support system.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Figure 1:
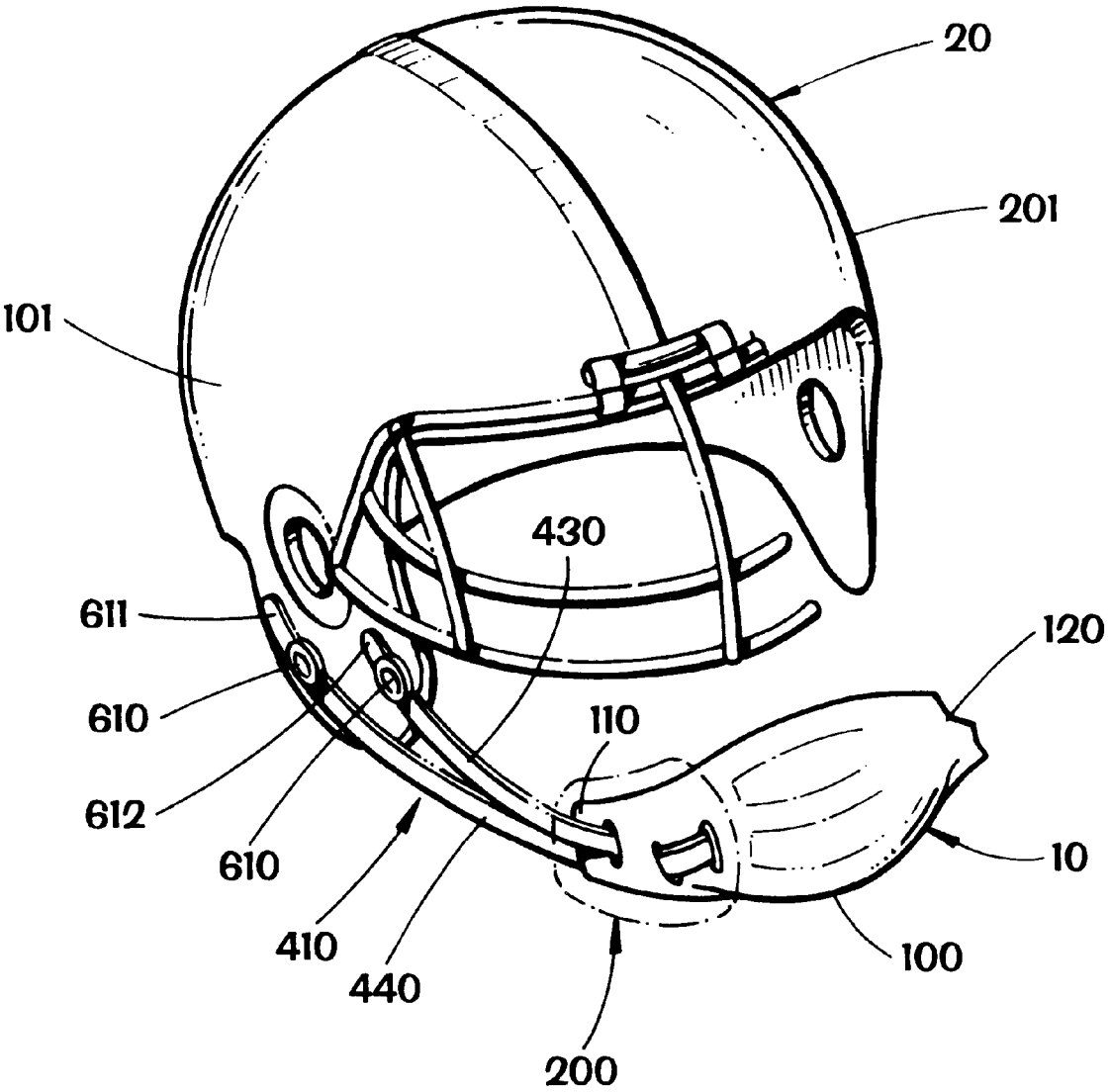
FIG. 1 is a partial perspective view of a helmet having a chin strap assembly in accordance with the present invention.
Figure 2:
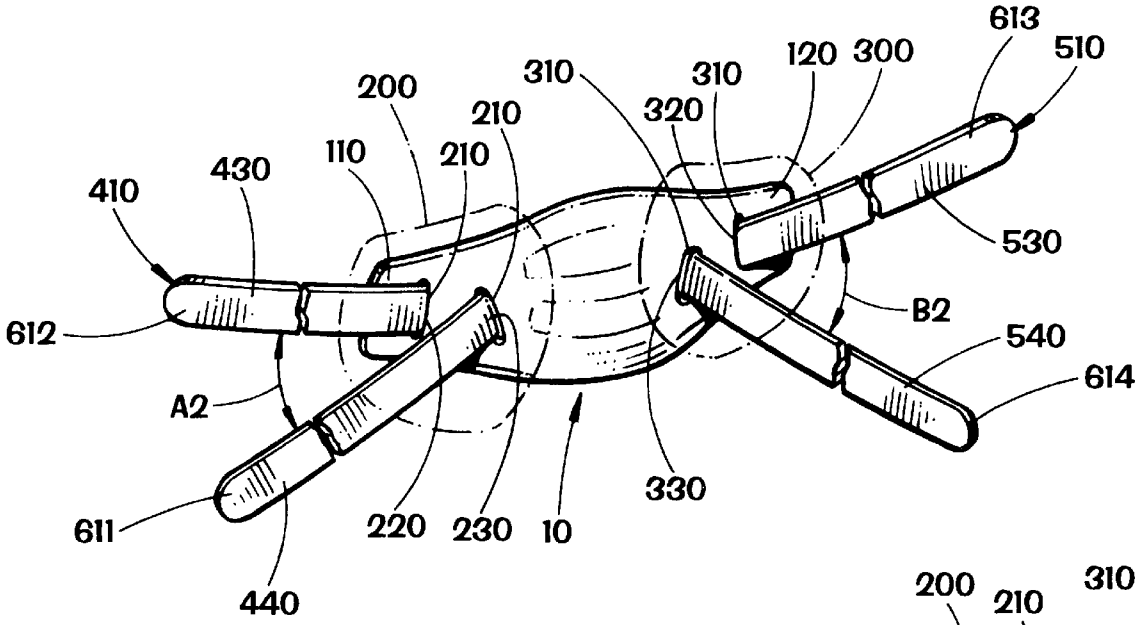
FIG. 2 is a partial perspective view of a first embodiment of a chin strap assembly in accordance with the present invention.
Figure 3:
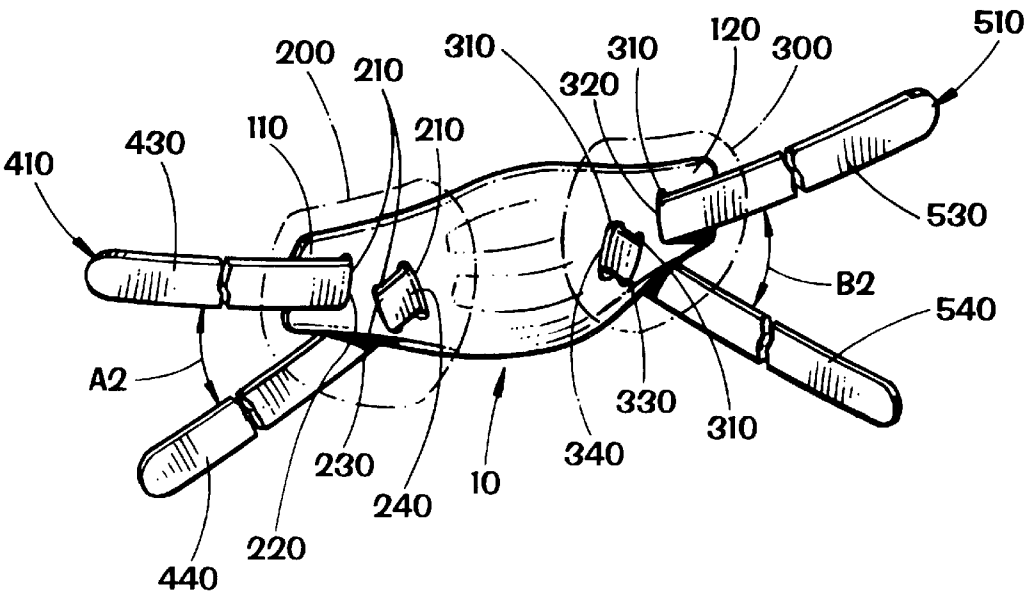
FIG. 3 is a partial perspective view of a second embodiment of the chin straps assembly in accordance with the present invention.
Figure 4:
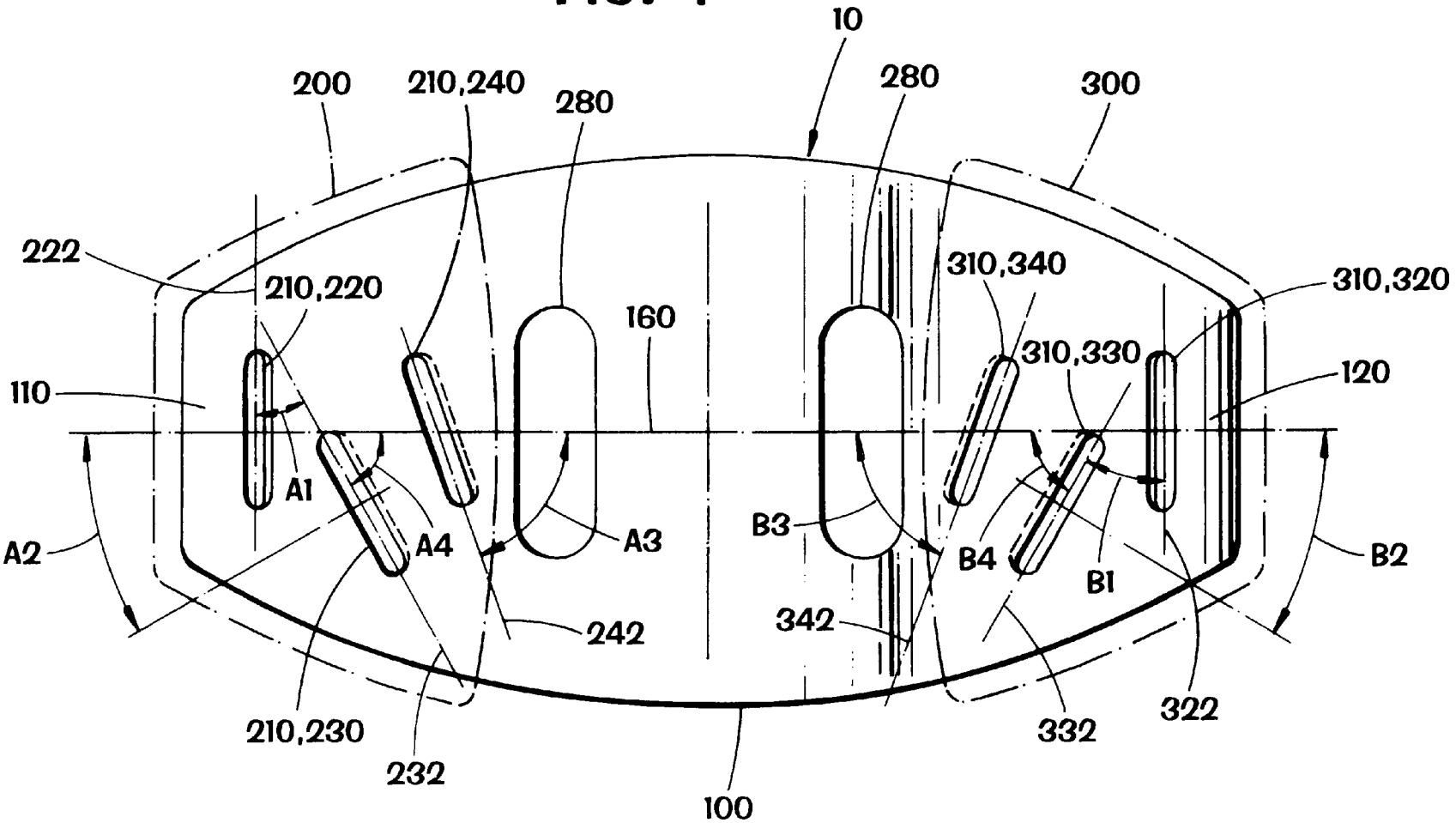
FIG. 4 is a front view of the chin cup member in accordance with the present invention.

As shown in FIGS. 1–4, an adjustable chin strap assembly 10, in accordance with the present invention is shown attached to an athletic helmet 20 (FIG. 1) having opposing sides 101, 201 (FIG. 1). A chin cup member 100, which may be relatively rigid if desired, is provided having first and second opposing sides 110, 120, respectively. First and second strap adjustment means 210, 310 are formed integral with, and located on, first and second opposing sides 110, 120 of chin cup member 100 and may comprise connecting portions 200, 300 formed integral with the chin cup member 100, with the connecting portions 200, 300 including first and second through-extending slots 220, 320, and 230, 330, respectively which are formed in connecting portions 200, 300. In a preferred embodiment, first through-extending slots 220, 320 are provided proximate opposing sides 110, 120 of chin cup member 100 and have long axes 222, 322 associated therewith (FIG. 4). With reference to FIG. 4, first through-extending slots 220, 320 are oriented with their long axes 222, 322 disposed generally perpendicular to the central, or longitudinal, axis 160 of chin cup member 100. A first support member, or flexible strap, 410 (FIGS. 1–3), having an upper portion 430 and a lower portion 440, and a second support member, or flexible strap, 510, having an upper portion 530 and a lower portion 540, may be threadably disposed respectively through slots 220, 230 and slots 320, 330, with upper portion 430 of first flexible strap 410, and upper portion 530 of second flexible strap 510, extending from and substantially colinear with the central axis 160 of chin cup member 100.

Second through-extending slots 230, 330 are similarly provided proximate opposing sides 110, 120 of chin cup member 100 and have long axes 232, 332 associated therewith. Second through-extending slots 230, 330 are spaced-apart and angled from first through-extending slots 220, 320, the long axes 232, 332 of second through-extending slots 230, 330 being oriented with long axes 232, 332 of second through extending slots 230, 330 and long axes 222, 322 of first through-extending slots 220, 320 forming angles A1, B1 therebetween having a value in the range of between 10 and 45 degrees. Preferably, the value of angles A1, B1 is approximately 30 degrees. Second through-extending slots 230, 330 are also spaced-apart and angled from first through-extending slots 220, 320 so that first flexible strap 410 (FIGS. 1–3) and second flexible strap 510 (FIGS. 2–3) may also be passed through second through-extending slots 230, 330, whereby lower portion 440 of first flexible strap 410 (FIGS. 1–3) and lower portion 540 of second flexible strap 510 (FIGS. 2–3) extend from chin cup member 100, defining fixed angles A2, B2 with respect to upper portion 430 of first flexible strap 410 and upper portion 530 of second flexible strap 510. Angle A2, defined between upper portion 430 and lower portion 440 of first flexible strap 410, and angle B2, defined between upper portion 530 and lower portion 540 of second flexible strap 510, preferably have a value in the range of between 10 degrees and 45 degrees. In a preferred embodiment, angle A2 and angle B2 are approximately 30 degrees.

In one embodiment, shown in FIG. 2, the use of only first and second through-extending slots 220, 320, and 230, 330, respectively, in combination with first and second flexible straps 410, 510, respectively, provide a fixed angular configuration between the upper portions 430, 530 and lower portions 440, 540 of first and second flexible straps 410, 510, respectively. In operation, a free end of each flexible strap 410, 510 may be threaded, or passed, first through first through-extending slot 220, 320 and then doubled back on itself through second through-extending slot 230, 330 at an angle A1, B1 and in a direction generally away from chin cup member 100 and generally in a direction towards athletic helmet 20, whereby the upper portions 430, 530 of straps 410, 510 may extend from chin cup member 100 forming an angle A2, B2 having a value of approximately 30 degrees from lower portions 440, 540 of straps 410, 510. In addition to the provision of a fixed angular configuration, the use of only first and second through-extending slots 220, 320, and 230, 330, respectively, in combination with first and second flexible straps 410, 510, respectively, provides some locking means to prevent undesired slippage of flexible straps 410, 510 when slack has been taken out of flexible straps 410, 510. However, when tension is removed from flexible straps. 410, 510, the relative lengths of upper portion 430, 530 and lower portion 440, 540 are manually adjustable by threading more or less of upper portion 430, 530 or lower portion 440, 540 through slots 220, 320, 230, 330. The desired configuration is then locked into place by again taking up the slack in flexible straps 410, 510.

In a preferred embodiment, shown in FIGS. 1, 3 and 4, use of a third through-extending slot 240, 340 may assist in preventing undesired slippage of flexible straps 410, 510 (FIGS. 2–3). Third through-extending slots 240, 340 may be provided spaced-apart and angled from both first and second through-extending slots 220, 320 and 230, 330, respectively. Third through-extending slot 240, 340 has a long axis 242, 342 (FIG. 4) associated therewith similar to long axis 222, 322, 232, 332 of first and second through-extending slots 220, 320, and 230, 330, respectively. Third through-extending slots 240, 340 are oriented with their long axis 242, 342 forming angles A3, B3 with the central axis 160 of chin cup member 100. Second through-extending slots 230, 330 are oriented with their long axis 232, 332 forming angles A4, B4 with the central axis 160 of chin cup member 100. Angles A4, B4 preferably have a value in the range of between 45 and 80 degrees. In a preferred embodiment, angles A4, B4 are approximately 60 degrees. The value of angles A3, B3 is selected from a range of between the value of angles A4, B4 and 105 degrees, or in a range of between 45 and 115 degrees. In a preferred embodiment, angles A3, B3 are preferably 70 degrees. Angles A3, B3 are also selected so that first flexible strap 410 or second flexible strap 510 may be threadably disposed, or passed, through slots 240, 340, while at the same time being threadably disposed through and extending from first and second through-extending slots 220, 320, and 230, 330, respectively, as shown in FIG. 3.

By way of example only, if angles A4, B4 of second through-extending slots 230, 330 have a value of 60 degrees from the central axis 160 of chin cup member 100, so that angles A1, B1 and corresponding angles A2, B2 (FIGS. 2–3) have a value of 30 degrees, then long axis 242, 342 of third through-extending slots 240, 340 may preferably form angles A3, B3 with central axis 160 of chin cup member 100 having a value in a range between 45 and 115 degrees and preferably 70 degrees. The value of angles A3, B3 should be selected so that it its value is always greater than the value of angles A4, B4 but less than, or equal to, 115 degrees. As shown in FIG. 3, flexible straps 410, 510 may first be threadably disposed through first through-extending slots 220, 320 colinear with central axis 160 of chin cup member 100. Flexible straps 410, 510 may then pass colinearly with central axis 160 of chin cup member 100 generally in the direction of third through-extending slots 240, 340. Flexible straps 410, 510 may then threadably pass through third through-extending slots 240, 340 and extend therefrom generally in a direction towards second through-extending slots 230, 330. Flexible straps 410, 510 may then threadably pass through second through-extending slot 230, 330 and extend therefrom generally in a direction towards athletic helmet 20 and at angles A2, B2 from central axis 160 having a value of approximately 30 degrees. The use of third through-extending slots 240, 340 may assist in preventing undesired slippage of flexible straps 410, 510, and may facilitate the lateral bending of strap 410, 510 as it doubles back on itself and is alternately threaded through first, second, and third through-extending slots 220, 320, 230, 330, and 240, 340, respectively.

FIGS. 1 and 3 show first flexible strap 410, threadably disposed through first, second, and third through-extending slots 220, 230, and 240, respectively, and having upper portion 430 and lower portion 440 of strap 410 snapably attached proximate end portions 611, 612, 613, 614, of strap 410 (FIGS. 1 and 2) to the side of athletic helmet 20 using attachment means, which could include fasteners 610, such as conventional snaps 610, which are well known in the art. Thus, the desired position of chin cup member 100 with respect to upper portion 430 or lower portion 440 of flexible strap 410 may be adjusted by alternately threading more or less of upper portion 430 or lower portion 440 through connecting portion 200, or adjustment means 210, 310, of chin cup member 100, while always maintaining the desired exit angle A2 between upper portion 430 and lower portion 440 of strap 410. Although not shown, second flexible strap 510 is similarly affixed to opposing side 201 of athletic helmet 20. Such a configuration eliminates the need of a separate means to fasten two separate flexible straps to one another to provide desired exit angle A2. Because a single flexible strap 410, 510 is used to support each side of chin cup member 100 without the need for other separate strap connectors, such as rivets, the strength of the connection between chin cup member 100 and flexible straps 410, 510 may be limited only by the breaking strength of chin cup member 100 and flexible straps 410, 510. The present invention always provides a fixed exit angle A2, B2 between upper portions 430, 530 and 440, 540 of flexible straps 410, 510, thus lessening the risk that a user may improperly adjust the exit angles A2, B2. The respective lengths of upper portion 430 and lower portion 440 may still be adjusted, if desired, by use of adjustable fasteners 610, which would affect the lateral position of chin cup member 100 on the wearer's chin with respect to opposing sides 101, 201 of athletic helmet 20 as well as the snugness of the fit.

A variety of chin foam inserts (not shown), in terms of thicknesses or shapes may be 20 disposed within chin cup member 100, as is conventional in the art to help absorb impact forces. The chin cup member may also include one or more ventilation slots 280 (FIG. 4).

It is to be understood that the invention is not to be limited to the exact details of construction, operation, exact materials or embodiments shown and described, as obvious modifications and equivalents will be apparent to one skilled in the art. Accordingly, the invention is therefore to be limited only by the scope of the appended claims.

What is claimed is:

1. An adjustable chin strap assembly for an athletic helmet, comprising:

a chin cup member, having first and second opposing sides;

first and second strap adjustment means formed integral with, and located on, the first and second opposing sides of the chin cup member, respectively;

a first separate support member for supporting the first side of the chin cup member with respect to the helmet;

a second separate support member for supporting the second side of the chin cup member with respect to the helmet; and attachment means for securing the support members to the athletic helmet.

2. The adjustable chin strap assembly of claim 1, wherein the first and second support members each include a separate flexible strap with an end portion, the first separate flexible strap being threadably attached through the first strap adjustment means and the second separate flexible strap being threadably attached through the second strap adjustment means.

3. The adjustable chin strap assembly of claim 2, wherein each strap adjustment means includes:

a connecting portion formed integral with the cup member, the connecting portion including first and second through-extending slots.

4. The adjustable chin strap assembly of claim 3, wherein the first and second through-extending slots each have a long axis associated therewith, the long axis defining a predetermined angle therebetween.

5. The adjustable chin strap assembly of claim 4, wherein the predetermined angle is approximately 30 degrees.

6. The adjustable chin strap assembly of claim 5, wherein the attachment means includes a fastener adapted to be secured to the athletic helmet and slidably disposed in connection with the end portions of the first and second flexible straps for securing the support members to the athletic helmet.

7. The adjustable chin strap assembly of claim 6, wherein the first flexible strap is threadably disposed through the first and second through-extending slots of the first connecting portion of the chin cup member, and the second flexible strap is threadably disposed through the first and second through-extending slots of the second connection portion of the chin cup member.

8. An adjustable chin strap assembly for an athletic helmet, comprising:

a chin cup member, having first and second opposing sides and a central axis extending between the first and second opposing sides of the chin cup member;

first and second connecting portions formed integral with, and located on opposite sides of, the chin cup member, each connecting portion including first, second, and third through-extending slots, each slot having a long axis associated therewith, the long axis of the first through-extending slots of the first and second connecting portions are each disposed generally perpendicular to the central axis of the chin cup member, the long axis of the first and second through-extending slots of the first and second connecting portions defining an angle therebetween in a range of between 10 and 45 degrees, the long axis of the second through-extending slots of the first and second connecting portions defining an angle with respect to the central axis that is in a range of between 45 degrees and 80 degrees, and the long axis of the third through-extending slots of the first and second connecting portions defining an angle with respect to the central axis that is in a range of between 45 degrees and 115 degrees;

a first flexible strap, threadably passing through the first, second, and third through-extending slots of the first connecting portion, an upper portion of the first flexible strap disposed along the central axis of the chin cup member and being adapted to be attached to a first side of the athletic helmet, a lower portion of the first flexible strap extending from the second through-extending slot of the first connecting portion and being adapted to be attached to the first side of the athletic helmet; and a second flexible strap, threadably passed through the first, second and third through-extending slots of the second connecting portion, an upper portion of the second flexible strap disposed along the central axis of the chin cup member and being adapted to be attached to a second side of the athletic helmet, a lower portion of the second flexible strap extending from the second through-extending slot of the second connecting portion and being adapted to be attached to the second side of the athletic helmet.

9. The adjustable chin strap assembly of claim 8, wherein the angle defined by the long axis of the first and second slots is approximately 30 degrees.

10. The adjustable chin strap assembly of claim 8, wherein the angle defined by the long axis of the second slot with respect to the central axis is approximately 60 degrees.

11. The adjustable chin strap assembly of claim 8, wherein the angle defined by the long axis of the third slot with respect to the central axis is approximately 70 degrees.

12. An adjustable chin strap for an athletic helmet, comprising:

(a) a chin cup member, having a central axis associated therewith;

first and second opposing sides;

at least three first slots extending therethrough proximate the first opposing side of the chin cup member, each of the at least three first slots being angularly disposed with respect to the central axis and adapted to receive a flexible strap; and at least three second slots extending therethrough proximate the second opposing side of the chin cup member, each of the at least three second slots being angularly disposed with respect to the central axis and adapted to receive a flexible strap;

(b) a single first flexible strap, threadably disposed through the at least three first slots of the first opposing side of the chin cup member, an upper portion of the first flexible strap extending in a direction generally away from the chin cup member and generally along the central axis of the chin cup member, and a lower portion of the first flexible strap extending in a direction generally away from the chin cup along an axis angularly disposed approximately 30 degrees from the central axis of the chin cup member; and (c) a single second flexible strap, threadably disposed through the at least three second slots of the second opposing side of the chin cup member, an upper portion of the second flexible strap extending in a direction generally away from the chin cup member and generally along a central axis of the chin cup member, and a lower portion of the second flexible strap extending in a direction generally away from the chin cup and angularly disposed approximately 30 degrees from the central axis of the chin cup member;

whereby the single first flexible strap may be affixed to a first side of the athletic helmet at two spaced-apart locations, and whereby the single second flexible strap may be affixed to a second, opposing, side of the athletic helmet at two spaced-apart locations.

* * * * *